US009402424B2

(12) United States Patent
Roy

(10) Patent No.: US 9,402,424 B2
(45) Date of Patent: Aug. 2, 2016

(54) BRASSIERE

(71) Applicant: KELLIE K APPAREL LLC, Los Angeles, CA (US)

(72) Inventor: Anthony Roy, Los Angeles, CA (US)

(73) Assignee: Kellie K Apparel LLC, Los Angeles, CA (US)

( * ) Notice: Subject to any disclaimer, the term of this patent is extended or adjusted under 35 U.S.C. 154(b) by 0 days.

(21) Appl. No.: 14/825,684

(22) Filed: Aug. 13, 2015

(65) Prior Publication Data

US 2015/0342268 A1 Dec. 3, 2015

Related U.S. Application Data

(63) Continuation of application No. PCT/US2014/016602, filed on Feb. 14, 2014.

(60) Provisional application No. 61/764,862, filed on Feb. 14, 2013.

(51) Int. Cl.
*A41C 3/06* (2006.01)
*A41C 5/00* (2006.01)

(52) U.S. Cl.
CPC ..... *A41C 3/065* (2013.01); *A41C 5/005* (2013.01)

(58) Field of Classification Search
CPC ..... A41C 3/06; A41C 3/44; A41C 3/0057; A41C 3/12; A41C 3/126; A41C 3/0014; A41C 3/065; A41C 3/00
USPC ..... 450/81, 39, 86, 88, 106, 112; 2/237, 2/236, 221, 220
See application file for complete search history.

(56) References Cited

U.S. PATENT DOCUMENTS

| | | | | |
|---|---|---|---|---|
| 1,115,674 A | | 11/1914 | Jacob | |
| 2,289,679 A | * | 7/1942 | Porter | A41C 3/144 450/57 |
| 2,524,620 A | * | 10/1950 | Esther | A41C 3/06 450/41 |
| 2,628,356 A | * | 2/1953 | Rosenfield | A41C 3/06 450/41 |
| 2,988,087 A | * | 6/1961 | Krieger | A41C 3/06 450/81 |
| 3,254,653 A | * | 6/1966 | Krieger | A41C 3/00 450/39 |

(Continued)

FOREIGN PATENT DOCUMENTS

| | | |
|---|---|---|
| GB | 2463888 A | 3/2010 |
| WO | WO 2014/127291 A2 | 8/2014 |

OTHER PUBLICATIONS

International Search Report and Written Opinion for PCT/US2014/016602 mailed Aug. 11, 2014.

(Continued)

*Primary Examiner* — Gloria Hale
(74) *Attorney, Agent, or Firm* — Brooks Acordia IP Law, PC; Douglas N. Larson

(57) ABSTRACT

A bra that adheres to the wearer's torso, enabling the bra to stay securely in place while aesthetically lifting the wearer's breasts up and out. At least one adhesive patch that includes soft silicone affixed to the fabric of the bra, primarily in the areas adjacent to the cups, is provided. The soft silicone adheres to the wearer's skin via Van Der Waals forces, and a secondary layer of silicone or fabric may be used to secure that adhesion. The Van Der Waals adhesion mechanism can be enhanced by the inclusion of micrometer-sized setae along the soft silicone portion of the adhesive patches. The setae can be angled to provide additional support in the desired direction.

39 Claims, 6 Drawing Sheets

(56) References Cited

U.S. PATENT DOCUMENTS

| | | | | |
|---|---|---|---|---|
| 3,276,449 | A | 10/1966 | Morgan | |
| 6,180,178 | B1 * | 1/2001 | Vogt | A41C 3/0014 128/101.1 |
| 6,332,825 | B1 | 12/2001 | Henricksen | |
| 6,446,268 | B1 | 9/2002 | Lazarian | |
| 6,827,628 | B2 | 12/2004 | Kaye et al. | |
| 6,852,001 | B2 | 2/2005 | Chen et al. | |
| 7,052,359 | B2 | 5/2006 | Chen et al. | |
| 7,132,161 | B2 | 11/2006 | Knowles et al. | |
| 7,335,086 | B1 | 2/2008 | Karon | |
| 7,422,508 | B2 * | 9/2008 | Bentham | A41C 3/0014 2/243.1 |
| 7,682,219 | B2 | 3/2010 | Falla | |
| 7,780,810 | B2 | 8/2010 | Hamano | |
| 7,811,272 | B2 | 10/2010 | Lindsay et al. | |
| 7,927,179 | B2 | 4/2011 | Kaye | |
| 8,128,457 | B2 | 3/2012 | Reinisch et al. | |
| 8,317,567 | B2 | 11/2012 | Watrin et al. | |
| 8,424,474 | B2 | 4/2013 | Berns | |
| 8,517,794 | B2 | 8/2013 | Thompson | |
| 8,684,789 | B2 * | 4/2014 | Gramelspacher | A41C 3/065 450/81 |
| 2003/0040256 | A1 * | 2/2003 | Waitz | A41C 3/12 450/86 |
| 2003/0186620 | A1 * | 10/2003 | Kaye | A41F 15/005 450/86 |
| 2005/0020184 | A1 * | 1/2005 | Izcoa | A41F 15/007 450/86 |
| 2005/0266770 | A1 | 12/2005 | Henricksen | |
| 2006/0166603 | A1 | 7/2006 | Chen | |
| 2006/0223415 | A1 * | 10/2006 | Watrin | A41C 3/0014 450/39 |
| 2007/0298682 | A1 | 12/2007 | Liu | |
| 2009/0053441 | A1 | 2/2009 | Cain et al. | |
| 2009/0093190 | A1 | 4/2009 | Wooley | |
| 2010/0183814 | A1 | 7/2010 | Rios et al. | |
| 2010/0252177 | A1 | 10/2010 | Sargent et al. | |
| 2010/0297912 | A1 | 11/2010 | Falla | |
| 2011/0171430 | A1 | 7/2011 | Mayers et al. | |
| 2011/0209262 | A1 | 9/2011 | Waldman et al. | |
| 2011/0256801 | A1 | 10/2011 | Cho | |
| 2012/0107570 | A1 | 5/2012 | Ross et al. | |
| 2012/0108143 | A1 | 5/2012 | Sherwood | |
| 2012/0225607 | A1 * | 9/2012 | Martinet | A41C 3/126 450/41 |
| 2012/0319320 | A1 | 12/2012 | Sitti et al. | |

OTHER PUBLICATIONS

International Preliminary Report on Patentability PCT/US2014/016602 mailed Apr. 6, 2015.

Parness,Esparza,Soto,Cutkosky,"Directional adhesives with hierarchy,"Proceedings of the National Academy of Sciences of the United States of America, pp. 1-5.

Parness,Esparza,Soto,Cutkosky,"Supplementary Information," Proceedings of the National Academy of Sciences of the United States of America, pp. 1-4, 2-3.

Mack, Eric, "Gecko's Sticky Secret: A Lot of Toe Hair", FORBES, Aug. 12, 2014, Downloaded from the Internet on Aug. 14, 2014, URL:<http://onforb.es/1sOOTXF>.

Bartlett et al, "Looking Beyond Fibrillar Features to Scale Gecko-Like Adhesion" 2012, 24, Advanced Materials, Communication, Wiley online library.com, pp. 1078-1083.

Asbeck et al.,"Climbing rough vertical surfaces with hierarchical directional adhesion," University of Stanford, Stanford, CA 94305, pp. 1-6.

* cited by examiner

BRASSIERE

CROSS-REFERENCE TO RELATED APPLICATIONS

This is a continuation of copending International application PCT/US2014/016602, filed Feb. 14, 2014, and which claims the benefit of provisional application Ser. No. 61/764,862, filed Feb. 14, 2013, and the entire contents of both of these applications are hereby incorporated by reference.

BACKGROUND

This disclosure relates to brassieres (primarily strapless brassieres and but also those with straps), dresses, swimsuits, socks, tops and other articles of clothing (or the like) that have a tendency to fall down or off, their constructions and methods of making them.

SUMMARY

Disclosed herein is a novel construction of a brassiere that can have an anisotropic, synthetic setae lining.

According to one aspect a strapless bra is disclosed that is able to support a wearer's breasts as effectively as a bra with straps. As opposed to other strapless bras that either flatten the wearer's breast, constantly slide down, or both, a strapless bra herein adheres to the wearer's torso, enabling the bra to stay securely in place while aesthetically lifting the wearer's breasts up and out. This is achieved by the use of at least one adhesive patch that is comprised of soft silicone affixed to the fabric of the bra, primarily in the areas adjacent to the cups. The soft silicone adheres to the wearer's skin via Van Der Waals forces, and a secondary layer of silicone or fabric may be used to secure that adhesion. Furthermore, the Van Der Waals adhesion mechanism can be enhanced by the inclusion of micrometer-sized setae along the soft silicone portion of the adhesive patches. These setae can be angled to provide additional support in the desired direction.

According to another aspect disclosed herein is a bra that includes: a fabric construction including bra cups; adhesive on an inner surface of the construction; and the adhesive using a first polymer having a first hardness of between Shore OO 05 and Shore A 10 and a second polymer. As a preferred example, the second polymer can have a second hardness of between Shore A 10 and Shore A 50.

According to a further aspect disclosed herein is a bra that includes a fabric construction including bra cups and adhesive patches on an interior surface of the construction where the patches include a soft silicone polymer having a Shore A Durometer of 10 or less and a fabric, non-elastic backing.

According to a yet further aspect disclosed herein is a bra that includes: a fabric construction including bra cups; a plurality of patches on an inner surface of the construction; the patches having adhesive with setae. As a preferred example, the setae can have a cylindrical shape, a diameter between 0.10 micrometer and 15.0 micrometers, and a length of between 1.5 micrometers and 60 micrometers. The dimensions of the setae are thereby uniquely optimized to the average microroughness of human skin.

According to a still yet further aspect disclosed herein is a bra that includes: a fabric construction including bra cups; a plurality of patches on an inner surface of the construction; and the patches having adhesive with setae. As an example, the setae can have a cylindrical shape, a diameter between 0.10 micrometer and 15.0 micrometers, and a length of between 1.5 micrometers and 60 micrometers. The patches can be made from a silicone having a first hardness of between Shore OO 05 and Shore A 10. The patches can be backed by a second polymer having a second hardness of between Shore A 10 and Shore A 50.

According to another aspect disclosed herein is a bra that includes a fabric construction including bra cups and adhesive on an inner surface of the construction. The adhesive can use a silicone having a Shore A hardness of 10 or less.

According to yet another aspect disclosed herein is a bra that includes: a fabric construction including first and second bra cups and a first back strap portion, an opposite second back strap portion and a center gore portion. The bra can further include one or more of the following: (a) a first adhesive wing patch on the first back strap portion and having setae angling upwardly, and a second adhesive wing patch on the second back strap portion and having setae angling upwardly; (b) a first adhesive cup patch on the first cup and having setae angling towards a center of the first cup, and a second adhesive cup patch on the second cup and having setae angling towards a center of the second cup; (c) a first front band patch on a front band underneath the first cup and having setae angling towards a center of the first cup or upwards, and a second front band patch on a front band underneath the second cup and having setae angling towards a center of the second cup; and (d) a gore patch on the center gore portion and having setae angling upwards.

According to another aspect disclosed herein is a bra that includes: a fabric construction including bra cups, a gore and wings adjacent to the cups; and adhesive patches on interior surfaces of the construction and on the gore and on the wings. The adhesive patches can include silicone portions of a singular hardness or dual hardness.

According to another aspect disclosed herein is a bra that includes: a fabric construction including bra cups; adhesive patches with setae on an inner surface of the construction, which can include (a) a non-elastic fabric center gore connecting the cups, (b) non-elastic fabric wings adjacent to the cups, and (c) a band positioned adjacent to the wings that is either a singular section or two separate sections able to clasp together and encircle the wearer and made primarily from an elastic material except along at least one non-elastic inner section of the band. At least one of the adhesive patches is on each non-elastic inner section. As an example, the fabric of the cups can be sewn foam, a thermoset foam, an elastic fabric a non-elastic fabric or any combination thereof. As examples, the setae can have a diameter between 0.10 micrometer and 15.0 micrometers, a length between 1.5 micrometers and 60 micrometers, and a spacing of between 2.7 and 3.0 micrometers.

According to yet another aspect disclosed herein is a strapless bra which includes: a fabric construction including bra cups; at least one adhesive patch on an interior surface of the fabric construction and configured to releasably adhere the fabric construction to the skin of a wearer of the strapless bra; the at least one adhesive patch including an adhesive patch; and the adhesive patch including: a first silicone layer of a soft silicone polymer; and a second silicone layer of a harder silicone polymer, which is harder than the soft silicone polymer.

According to a still yet another aspect disclosed herein is a strapless bra which includes: a fabric construction including bra cups; at least one adhesive patch on an interior surface of the fabric construction and configured to releasably adhere the fabric construction to the skin of a wearer of the strapless bra; and the at least one adhesive patch including an adhesive patch. The adhesive patch includes: a layer of a soft silicone polymer; the soft silicone polymer having a hardness of less than Shore A 10; a layer of fabric embedded within the soft silicone polymer; the layer of fabric having less than 5% stretch in any direction; a layer of harder silicone polymer between the layer of soft silicone polymer and the fabric construction; and the harder silicone polymer having a hardness of at least Shore A 10.

According to a still yet another aspect disclosed herein is a strapless bra which includes: a fabric construction including bra cups; a fabric layer of the fabric construction having less than 5% stretch in any direction; at least one adhesive patch on an interior surface of the fabric construction and configured to releasably adhere the fabric construction to the skin of a wearer of the strapless bra; the at least one adhesive patch including an adhesive patch; and the adhesive patch including: (a) a layer of a soft silicone polymer; (b) the soft silicone polymer having a hardness of less than Shore A 10; (c) the layer of soft silicone polymer being attached to an area of the fabric construction where the fabric layer is permeated with hard silicone polymer; and (d) the harder silicone polymer having a hardness of at least Shore A 10.

According to another aspect disclosed herein is a method making an adhesive patch of a strapless bra, which includes: attaching a soft polymer layer to a fabric construction which is permeated with hard polymer; an exposed surface of the soft polymer layer when in a cured state forming an adhesive surface adapted for intimate contact with the skin of the wearer of the strapless bra; and the hard polymer being a harder polymer than the soft polymer of the cured soft polymer layer.

According to another aspect disclosed herein is a method of making an adhesive patch of a strapless bra, which includes: placing uncured hard polymer on an inward surface of a fabric construction; while the hard polymer is curing on and permeating into the inward surface, placing a cured soft polymer layer on the still-curing hard polymer and thereby the soft polymer layer becoming bonded to the fabric construction when the hard polymer cures and an exposed surface of the soft polymer layer forming an adhesive surface adapted for intimate contact with the skin of the wearer of the bra; and the hard polymer being a harder polymer than the soft polymer of the cured soft polymer layer.

According to another aspect disclosed herein is a method of making an adhesive patch of a strapless bra, the method including: placing uncured hard polymer on an inward surface of a fabric construction; and while the hard polymer is curing on and permeating into the inward surface, placing a cured soft polymer layer on the still-curing hard polymer and thereby the soft polymer layer becoming bonded to the fabric construction when the hard polymer cures and an exposed surface of the soft polymer layer forming an adhesive surface adapted for intimate contact with the skin of the wearer of the bra. The hard polymer is a harder polymer than the soft polymer of the cured soft polymer layer.

Other possible uses include conventional bras with patches/lining on the straps to keep the straps from falling off, swim suits, socks, and strapless dresses/tops, as well as reusable decals/decorations and other similar articles/constructions as would be apparent to those skilled in the art from this disclosure.

Further objects and advantages of the disclosure will become apparent from a consideration of the drawings and ensuing description.

DETAILED DESCRIPTION

According to one aspect, the present invention can concern a brassiere (or similar article of clothing or the like) that has a reversible adhesive lining to prevent unwanted movement of the brassiere. The lining, herein referred to as "Novel lining," can take advantage of two specific physical qualities/properties to advantageously achieve reversible adhesion. The first is anisotropic compliance, wherein the effective Young's Modulus of the Novel lining depends on the direction in which a load is supplied. The second is synthetic setae nanostructures on the intended interface between the Novel lining and the wearer's skin. Brassieres, etc. of the present disclosure with Novel lining may use one or both of these features.

Figure 1:
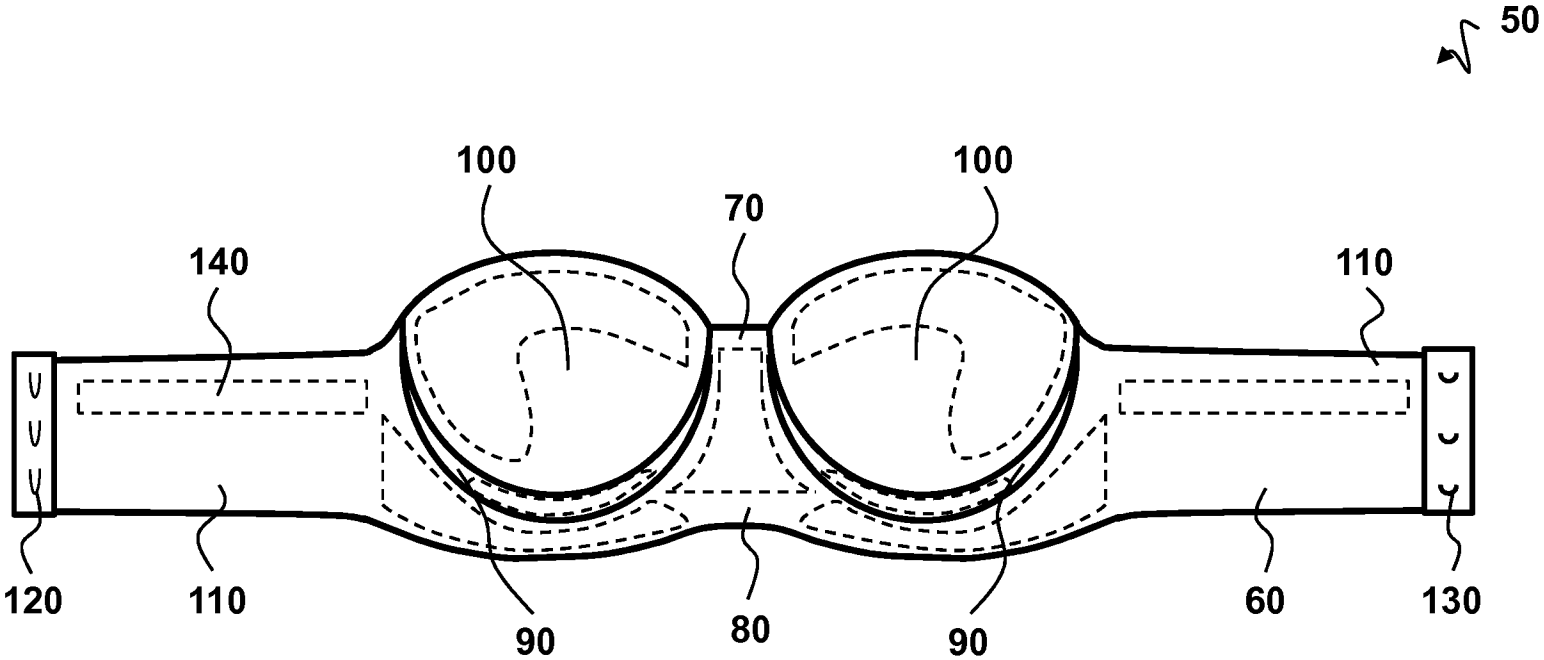
FIG. 1 is a front view of a brassiere of the present disclosure.

In a preferred embodiment and referring to FIG. 1, the brassiere shown generally at 50 can be a strapless brassiere 60 including a gore 70, chest band 80, underwire 90, two cups 100, two wings 110, a plurality of hooks 120, and a plurality of eyes 130. Patches 140 of Novel lining are placed on the gore, band, wings, underwire and cups (pursuant to one of the methods disclosed here, for example).

These patches 140 can be attached to the brassiere fabric at the locations illustrated in FIG. 1, for example. Other embodiments may not have Novel lining present on all of the above listed portions of the brassiere. Indeed, the brassiere itself may not feature all of the aforementioned features. Some embodiments can have a front band, will not have an underwire, or will feature a hook and eye clasp on the front of the brassiere between the cups.

One present disclosure in addition to including the entire construction of the bra (or other article of clothing or similar object) and the method of making same, also includes the construction and/or method of making the adhesive patches themselves.

The fabric of the cups 100 can be sewn foam, a therrmoset foam, an elastic fabric, a non-elastic fabric or any combination thereof. The elastic material of the bra fabric construction can have a percentage of stretch greater that 25% in any direction and the non-elastic fabric can have a percentage of stretch less than 5% in any direction.

The adhesive patches 140 can be attached to the interior surface of the bra construction, for example, by (a) permeating part of the fabric construction of the bra with silicone while the silicone cures, (b) using a permanent adhesive to attach the silicone portion to the fabric construction of the bra, (c) sewing a fabric portion of the adhesive patch into the fabric construction of the bra, or (d) sewing the silicone portion of the adhesive patch into the fabric construction of the bra such that the silicone portion is in between the wearer's skin and the fabric portion.

A specific example can be where the bra construction includes (a) a non-elastic fabric center gore connecting the cups, (b) non-elastic fabric wings adjacent to the cups, and (c) a band positioned adjacent to the wings that is either a singular section or two separate sections able to clasp together and encircle the wearer and made primarily from an elastic material except along a non-elastic inner section of the band. And at least one of the adhesive patches is on the non-elastic inner section.

According to another specific embodiment the patches can include a soft silicone polymer having a Shore A Durometer of 10 or less and a fabric, non-elastic backing. The backings have a non-elasticity greater than that of the polymer, are flexible along a transverse direction so the entire adhesive patch conforms to the skin of a wearer of the bra, and provide support to the silicone portion of the adhesive. The non-elastic backings can have a percentage of stretch less than 5% in any direction. The non-elastic backings can be formed by the fabric of the bra fabric construction. Additionally, for example, each of the non-elastic backings can be permeated with a thin layer of polymer with a hardness of between Shore A 10 and Shore A 50.

For another specific example, the construction can include a band underneath the cup with an underwire for the cups (FIG. 1). Adhesive patches are on the back of the band, on the front of the band, and on channeling containing the underwire.

In other embodiments, the entire brassiere feature/construction can be composed, covered by or lined with the Novel lining.

In a preferred embodiment, Novel lining is a combination of a soft silicone polymer and a rigid backing. In other embodiments, a polyurethane polymer can be used instead of silicone. The soft polymer 200 can have a Shore A Durometer hardness of 10 or less. The lining is then backed by another, less compliant material such as a thin layer of polymer 210 with greater hardness, shown in FIG. 2A, fabric 220 inserted into the soft polymer while the polymer is curing, shown in FIG. 2B, or a layered fabric 220 and harder polymer backing 210 added after the soft polymer has cured, shown in FIG. 2C.

The entire anisotropic composition of any of these configurations will result in relative compliance in the direction normal to the surface that interfaces with skin, shown as the z-axis below, but relative rigidity in the directions orthogonal to this normal. Likewise, the material is able to resist moments in the x-y plane, but easily bends under y-z or z-x moments. Various parts of the bra may use various backings (e.g., different patch constructions).

Figure 2C:
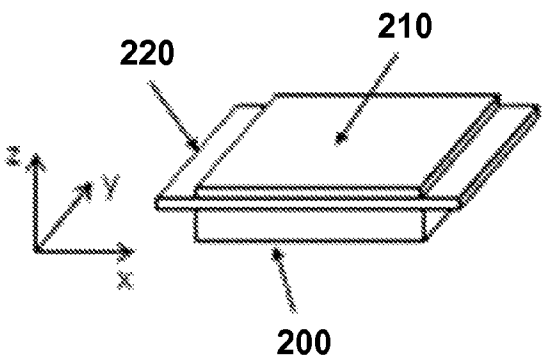
FIG. 2C is a perspective view of a portion of a third construction of the disclosure.
Figure 2B:
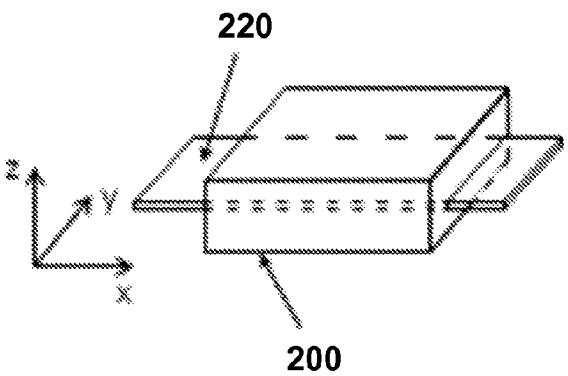
FIG. 2B is a perspective view of a portion of a second construction of the disclosure.
Figure 2A:
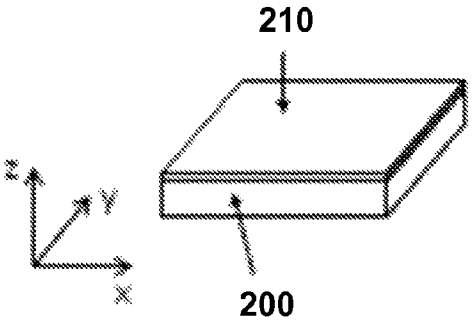
FIG. 2A is a perspective view of a portion of a first construction of the disclosure.

While preferred configurations can have the backing 210 shown in FIG. 2A along the underwire sections, the backing shown in FIG. 2B on the gore and cups sections, and the backing shown in FIG. 2C on the wing and front band sections, can be substituted.

FIGS. 2A, 2B and 2C can all start the same way. Namely, Novel lining can be made by pouring a binary silicone mixture into a mold where it cures into a Shore OO hardness. Novel lining with setae is poured into a mold with micro features, usually made via photolithography or some other known method. Novel lining without setae can be made in a conventional plastic mold, which would also be considered prior art and/or obvious. The silicone can be allowed to cure in the mold, and may or may not undergo a post-curing process where it is heated.

In FIG. 2A, there is no fabric, and the harder silicone 210 provides the necessary stiffness. In this case, the harder silicone might have a Durometer hardness that is much higher than 10 on the Shore A scale, on the order of 50 on the Shore A scale.

In FIG. 2B, there is no harder silicone. Fabric 220 can be attached to the soft silicone 200 by either being added during the curing of the soft silicone while it is in the mold in the first step, or similar to FIG. 2C, except a soft silicone is used instead of a hard silicone.

In FIG. 2C, after the soft silicone 200 has cured, a harder silicone 210 about a Shore A Durometer hardness of 10, is placed onto a non-stretch fabric 220, preferably 100% nylon. While it cures, the soft silicone from the mold is placed onto the still-curing harder silicone, which bonds it to the fabric 220.

1) Hardness of PDMS (Silicone)

There are two types of silicone in the present disclosure. The first can have a Shore A Durometer hardness less than 10, such as around 00-10 on the Shore 00 scale. The second can have a hardness that is nominally 10 on the Shore A Durometer scale.

As an example, the patches 140 can include adhesive with setae. They can be made from a silicone having a first hardness of between Shore OO 05 and Shore A 10, and be backed by a second polymer having a second hardness of between Shore A 10 and Shore A 50. The first hardness can be Shore OO 10 and the second hardness can be Shore A 10. The setae can have a cylindrical shape, a diameter between 0.10 micrometer and 15.0 micrometers, and a length of between 1.5 micrometers and 60 micrometers. Specifically, the diameter of the setae can be 1.5 micrometers and the length can be 5 micrometers.

2) Density of Setae

The spacing can vary between 2.7 micrometers to 3 micrometers, which leads to there being between 71.6 million and 88.5 million setae in each square inch of Novel lining. (Some embodiments herein also do not have setae.)

3) Construction Methods

The Novel lining can be made by pouring a binary silicone mixture into a mold where it cures into a Shore 00 00-10 hardness. Novel lining with setae is poured into a mold with micro features, usually made via photolithography or some other method that is known in prior art. Novel lining without setae can be made in a conventional plastic mold, such as is known in the prior art. The silicone is allowed to cure in the mold, and may or may not undergo a post-curing process where it is heated.

In a preferred embodiment (FIG. 2C), after the soft silicone has cured, a harder silicone, about a Shore A Durometer hardness of 10, is placed onto a non-stretch fabric, preferably 100% nylon. While it cures, the soft silicone from the mold is placed onto the still-curing harder silicone, which bonds it to the fabric.

Figure 3:
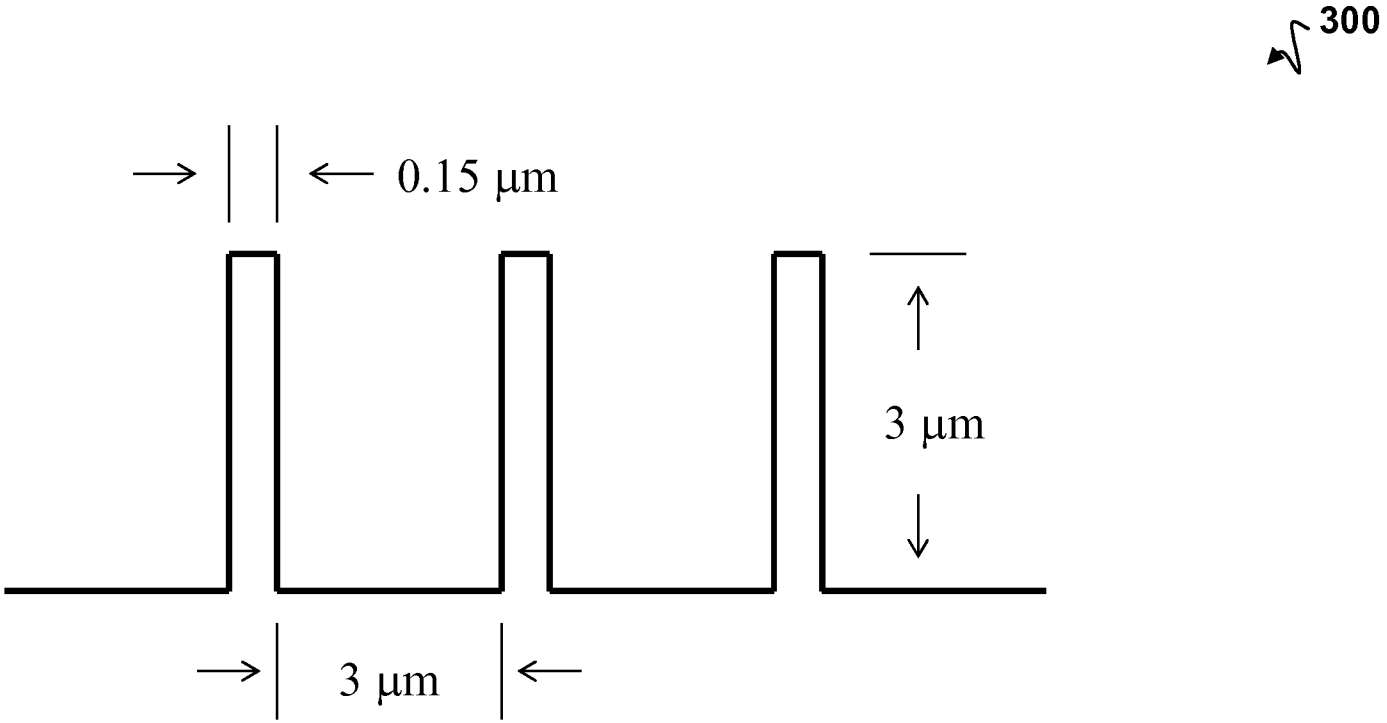
FIG. 3 shows a lining have synthetic setae.
Figure 4:
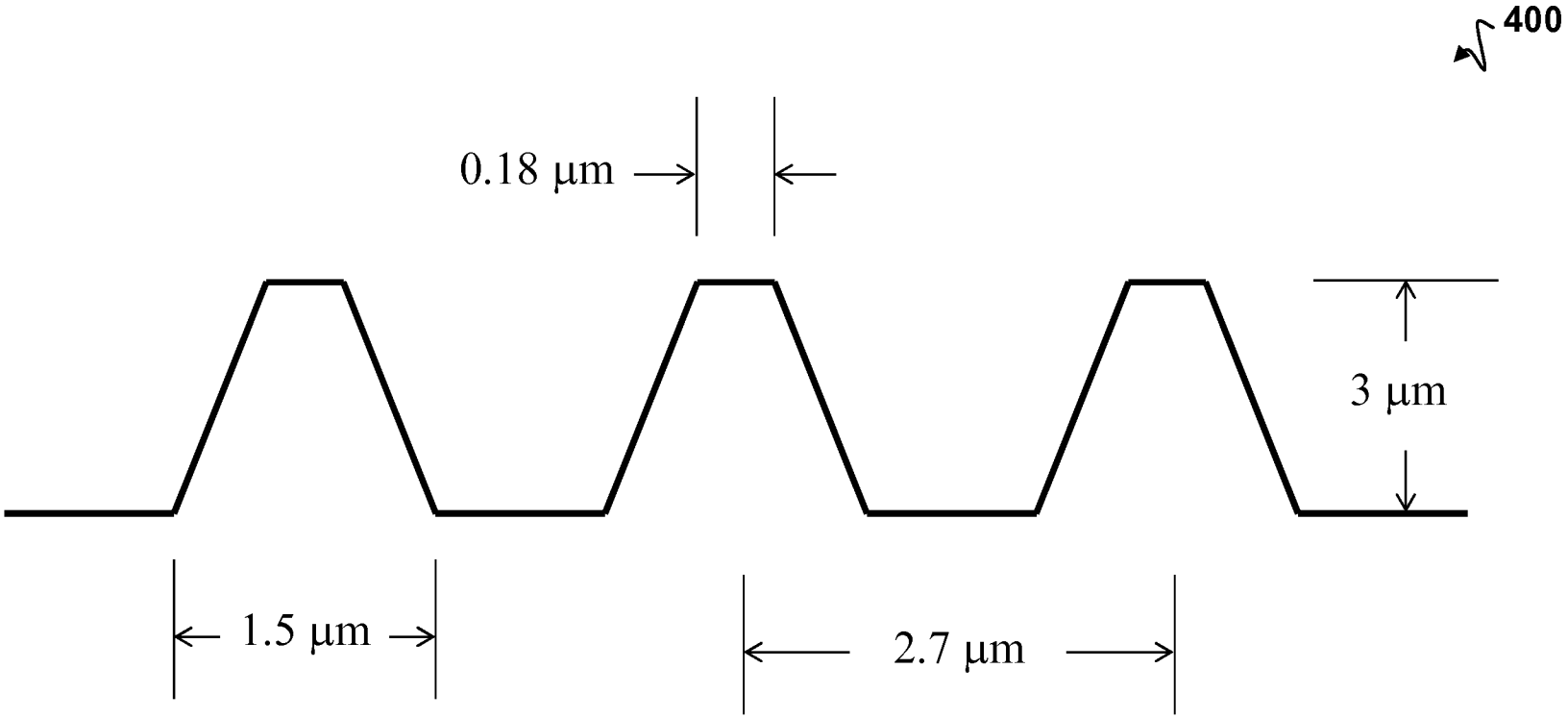
FIG. 4 shows a lining with cone-shaped (instead of cylindrically-shaped) synthetic setae.
Figure 5:
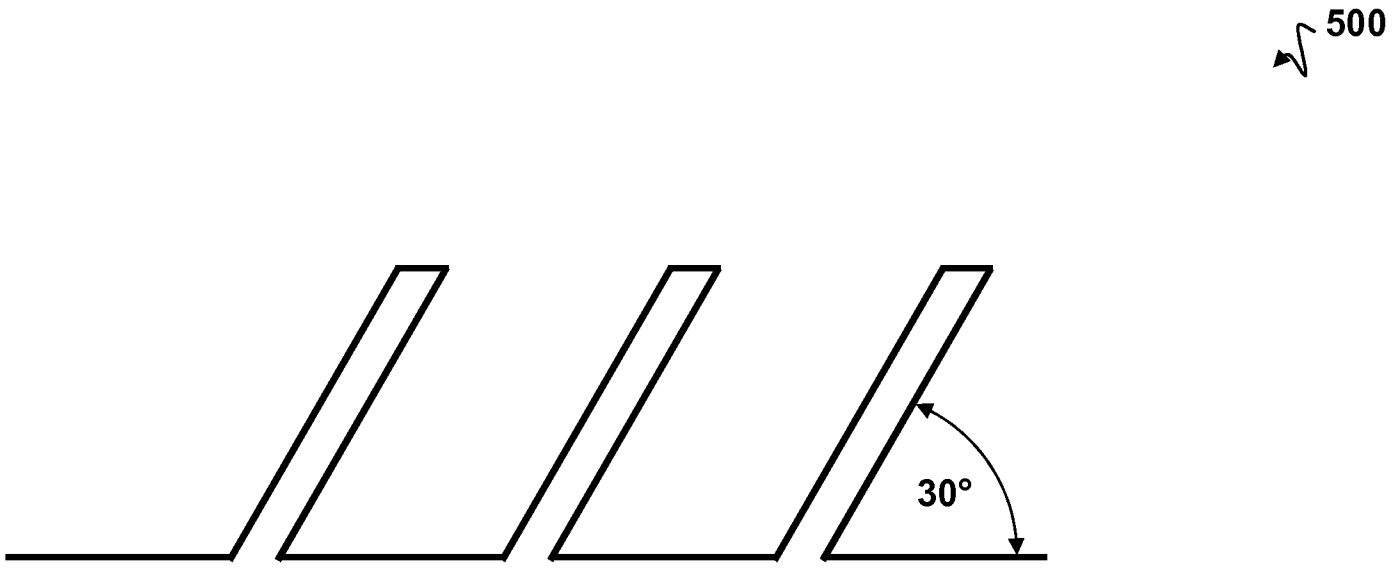
FIG. 5 shows a lining with setae that are angled with respect to the backing.

Novel lining can also have nanostructures, commonly called synthetic setae. A preferred embodiment can use the dimensions shown in FIG. 3 generally at 300. Other embodiments of synthetic setae can be cone shaped rather than cylindrically shaped, as shown in FIG. 4 generally at 400. Furthermore, these setae can be angled with respect to the backing, as shown in FIG. 5 generally at 500. Such angling causes the Novel lining to have increased adhesion when subjected to shear loads in the direction opposite of the tilt, yet be easily removed by applying a shear load in the direction of the tilt, as the inventor has discovered.

4) Angling of Setae

Figure 6:
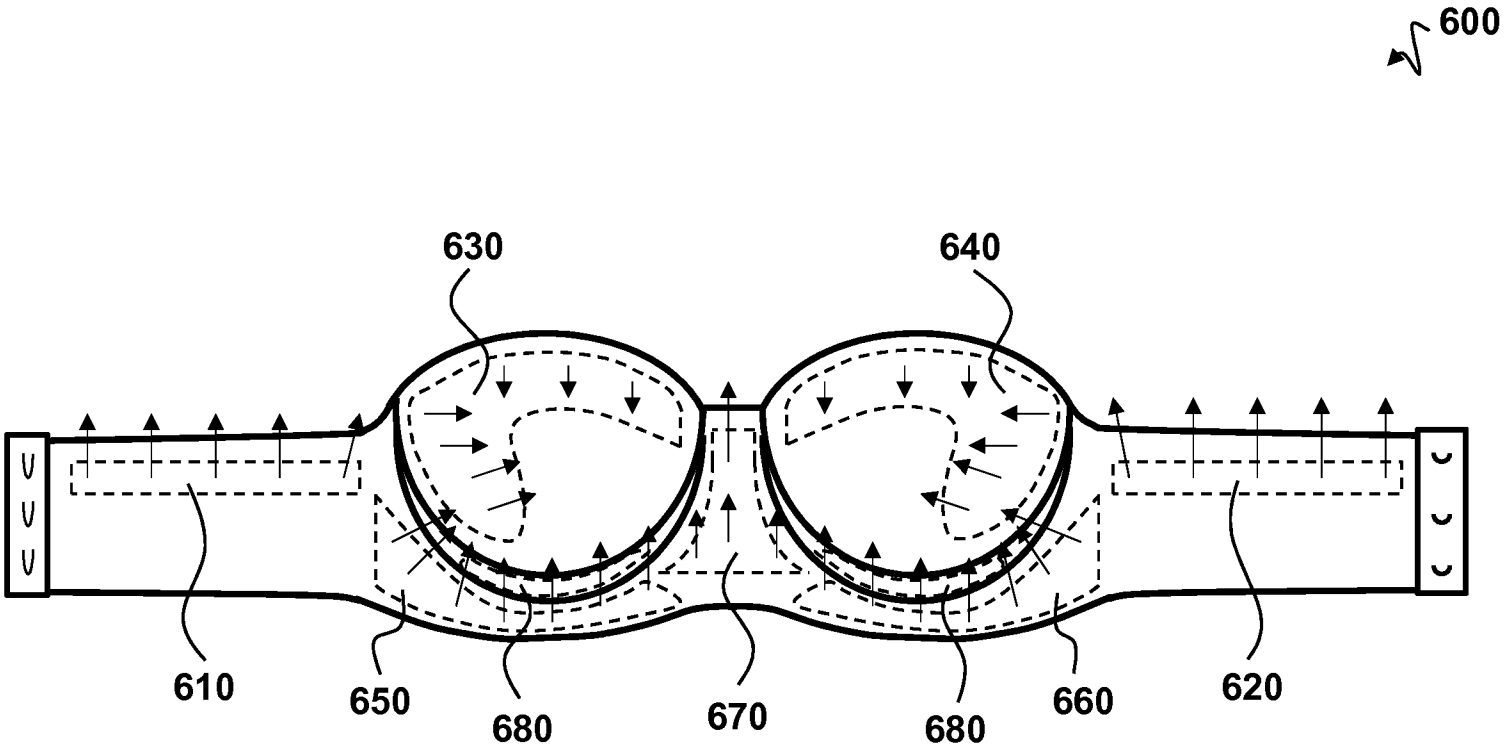
FIG. 6 shows a brassiere with angled setae.

FIG. 6 shows an embodiment of a brassiere generally at 600 with the synthetic setae on the Novel lining angled in the direction of the arrows. For example, the bra can further include one or more of the following: (a) a first adhesive wing patch 610 on the first back strap portion and having setae angling upwardly, and a second adhesive wing patch 620 on the second back strap portion and having setae angling upwardly; (b) a first adhesive cup patch 630 on the first cup and having setae angling towards a center of the first cup, and a second adhesive cup patch 640 on the second cup and having setae angling towards a center of the second cup; (c) a first front band patch 650 on a front band underneath the first cup and having setae angling towards a center of the first cup or upwards, and a second front band patch 660 on a front band underneath the second cup and having setae angling towards a center of the second cup; (d) a gore patch 670 on the center gore portion and having setae angling upwards; and (e) underwire patches 680.

5) Summary

1. Thus, disclosed herein is a bra which includes: a fabric construction including bra cups; adhesive on an inner surface of the construction; and the adhesive using a first polymer having a first hardness of between Shore OO 05 and Shore A 10 and a second polymer.

1a. The bra of paragraph 1 above wherein the second polymer has a second hardness of between Shore A 10 and Shore A 50.

1b. The bra of paragraph 1 wherein the first hardness is Shore OO 10 and the second hardness is Shore A 10.

1c. The bra of paragraph 1 wherein the first polymer having the first hardness makes intimate contact with the skin of the wearer of the bra to allow adhesion via Van Der Waals forces and the second polymer having a second hardness keeps adhesion by providing a structure that keeps the first polymer in place while the bra lifts and supports the wearer's breasts.

1d. The bra of paragraph 1 wherein the softer first polymer is against the skin of the user when the bra is being worn and the harder second polymer is not against the skin.

1e. The bra of paragraph 1 further comprising underwires for the bra cups.

1f. The bra of paragraph 1 wherein the construction includes a back strap.

1g. The bra of paragraph 1 wherein the fabric of the cups is sewn foam, a thermoset foam, an elastic fabric, a non-elastic fabric or any combination of the thereof.

1h. The bra of paragraph 1g wherein the elastic fabric has a percentage of stretch greater that 25% in any direction such as Spandex or Lycra and the non-elastic fabric non-elastic fabric has a percentage of stretch less than 5% in any direction such as cotton or nylon.

1i. The bra of paragraph 1g wherein the construction includes (a) a non-elastic fabric center gore connecting the cups, (b) non-elastic fabric wings adjacent to the cups, and (c) a band positioned adjacent to the wings that is either a singular section or two separate sections able to clasp together and encircle the wearer and made primarily from elastic material except along at least one non-elastic inner section of the band, and at least one adhesive patch being on each non-elastic inner section.

2. Also, disclosed herein is a bra which includes: a fabric construction including bra cups; adhesive patches on an interior surface of the construction; and the patches including a soft silicone polymer having a Shore A Durometer of 10 or less and a fabric, non-elastic backing.

2a. The bra of paragraph 2 above wherein the backings have a non-elasticity greater than that of the polymer.

2b. The bra of paragraph 2 wherein the non-elastic backings are flexible along a transverse direction so the entire adhesive patch conforms to the skin of a wearer of the bra.

2c. The bra of paragraph 2 wherein the non-elastic backings provide support to the silicone portion of the adhesive.

2d. The bra of paragraph 2 wherein the non-elastic backings are formed by the fabric of the fabric construction.

2e. The bra of paragraph 2 wherein each of the non-elastic backings is permeated with a thin layer of polymer with a hardness between Shore A 10 and Shore A 50.

2f. The bra of paragraph 2 wherein each of the non-elastic backings has a percentage of stretch less than 5% in any direction.

3. Further disclosed herein is a bra which includes: a fabric construction including bra cups; a plurality of patches on an inner surface of the construction; and the patches having adhesive with setae.

3a. The bra of paragraph 3 wherein the setae have a cylindrical shape, a diameter between 0.10 micrometer and 15.0 micrometers, and a length of between 1.5 micrometers and 60 micrometers.

3b. The bra of paragraph 3 wherein the diameter of the setae is 1.5 micrometers and the length is 5 micrometers.

3c. The bra of paragraph 3 wherein the construction includes a back strap, and further comprising underwires for the bra cups.

3d. The bra of paragraph 3 wherein the setae have a density between 71.6 million and 88.5 million setae per square inch.

4. Even further disclosed herein is a bra which includes: a fabric construction including bra cups; a plurality of patches on an inner surface of the construction; the patches having adhesive with setae; the patches being made from a silicone having a first hardness of between Shore OO 05 and Shore A 10; and the patches being backed by a second polymer having a second hardness of between Shore A 10 and Shore A 50.

4a. The bra of paragraph 4 above wherein the diameter of the setae is 1.5 micrometers and the length is 5 micrometers.

4b. The bra of paragraph 4 wherein the setae have a cylindrical shape, a diameter between 0.10 micrometer and 15.0 micrometers, and a length of between 1.5 micrometers and 60 micrometers.

4c. The bra of paragraph 4 wherein the first hardness is Shore OO 10 and the second hardness is Shore A 10.

4d. The bra of paragraph 4 wherein the construction includes a back strap, and further comprising underwires for the bra cups.

4e. The bra of paragraph 4 wherein the setae have a density between 71.6 million and 88.5 million setae per square inch.

5. Still further disclosed herein is a bra which includes: a fabric construction including bra cups; adhesive without setae on an inner surface of the construction; and the adhesive using a silicone having a Shore A hardness of 10 or less.

5a. The bra of paragraph 5 above wherein the silicone has a hardness of generally Shore OO 10.

5b. The bra of paragraph 5 further comprising underwires for the bra cups.

5c. The bra of paragraph 5 wherein the construction includes a back strap.

6. Additionally, disclosed herein is a bra which includes: a fabric construction including first and second bra cups and a first back strap portion, an opposite second back strap portion and a center gore portion; and one or more of the following: (a) a first adhesive wing patch on the first back strap portion and having setae angling upwardly, and a second adhesive wing patch on the second back strap portion and having setae angling upwardly; (b) a first adhesive cup patch on the first cup and having setae angling towards a center of the first cup, and a second adhesive cup patch on the second cup and having setae angling towards a center of the second cup; (c) a first front band patch on a front band underneath the first cup and having setae angling towards a center of the first cup or upwards, and a second front band patch on a front band underneath the second cup and having setae angling towards a center of the second cup; and (d) a gore patch on the center gore portion and having setae angling upwards.

6a. The bra of paragraph 6 above wherein the construction includes underwire.

6b. The bra of paragraph 6 including (a), (b) and (c).

6c. The bra of paragraph 6 wherein the patches are attached to the construction after the construction has been formed.

6d. The bra of paragraph 6 wherein the setae have a density between 71.6 million and 88.5 million setae per square inch.

7. Also disclosed herein is a bra which includes: a fabric construction including bra cups, a gore and wings adjacent to the cups; adhesive patches on interior surfaces of the construction and on the gore and on the wings; and the adhesive patches including silicone portions of a singular or dual hardness.

7a. The bra of paragraph 7 above wherein the adhesive patches further include a fabric portion that lies on the outside of the silicone portion, away from the wearer's skin.

7b. The bra of paragraph 7 wherein the adhesive patches are attached to the interior surface (a) by permeating part of the fabric construction of the bra with silicone while the silicone cures, (b) by using a permanent adhesive to attach the silicone portion to the fabric construction of the bra, (c) by sewing a fabric portion of the adhesive patch into the fabric construction of the bra, or (d) by sewing the silicone portion of the adhesive patch into the fabric construction of the bra such that the silicone portion is in between the wearer's skin and the fabric portion.

7c. The bra of paragraph 7 wherein the construction includes a band underneath the cup; and further comprising an underwire for the cups, and adhesive patches on the back of the band, on the front of the band, and on channeling containing the underwire.

7d. The bra of paragraph 7 wherein the construction includes a back strap with adhesive material in a mostly vertical orientation, where the silicone portion of the adhesive material is in between the wearer's skin and the fabric portion.

8. Still further, disclosed herein is a bra which includes: a fabric construction including bra cups; adhesive patches with setae on an inner surface of the construction; the setae having a diameter between 0.10 micrometer and 15.0 micrometers, a length between 1.5 micrometers and 60 micrometers, and a spacing between 2.7 and 3.0 micrometers; the fabric of the cups is sewn foam, a thermoset foam, an elastic fabric, a non-elastic fabric or any combination thereof; the construction including (a) a non-elastic fabric center gore connecting the cups, (b) non-elastic fabric wings adjacent to the cups, and (c) a band positioned adjacent to the wings that is either a singular section or two separate sections able to clasp together and encircle the wearer and made primarily from a elastic material except along a non-elastic inner section of the band; and at least one of the adhesive patches being on the non-elastic inner section.

8a. The bra of paragraph 8 above wherein the elastic material of the fabric construction has a percentage of stretch greater that 25% in any direction and the non-elastic fabric has a percentage of stretch less than 5% in any direction.

8b. The bra of paragraph 8 wherein the diameter is 0.15 micrometer and the length is 5.0 micrometers.

8c. The bra of paragraph 8 wherein the setae have a density between 71.6 million and 88.5 million setae per square inch.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including" and "having" are inclusive and therefore specify the presence of stated features, integers, steps, operations, elements and/or components, but do not preclude the presence or addition of one or more other features, integers, steps, operations, elements, components and/or groups thereof. The method steps, processes and operations described herein are not to be construed as necessarily requiring their performance in the particular order discussed or illustrated, unless specifically identified as an order of performance. It is also to be understood that additional or alternative steps may be employed.

Although the terms first, second, third and so forth may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second" and other numerical terms when used herein do not imply a sequence or order unless clearly indicated by the context. Thus, a first element, component, region, layer or section discussed below can be termed a second element, component, region, layer or section without departing from the aspects of the present teachings.

Spatially relative terms, such as "inner," "outer," "beneath," "below," "lower," "upper," "above," "forward," "rearward," "front" and "back" may be used herein for ease of description to describe one element's or feature's relationship to another, but the disclosure is intended to encompass different orientations of the construction in use or operation in addition to the orientation depicted in the figures. For example, if the construction in the figures is turned over, elements described as "below" or "beneath" other elements or features would then be oriented "above" the other elements or features. Thus, the example term "below" can encompass both an orientation of above and below. The construction may be otherwise oriented (rotated ninety degrees or at other orientations) and the spatially relative descriptors used herein interpreted accordingly.

Although the present inventions have been described in terms of preferred and alternative embodiments above, numerous modifications and/or additions to the above-described embodiments would be readily apparent to one skilled in the art. The embodiments can be defined as methods of use or assembly carried out by anyone, any subset of or all of the components and/or users; as constructions/assemblies/systems of one or more components in a certain structural and/or functional relationship; and/or as subassemblies or sub-methods. The inventions can include each of the individual components separately. However, it is intended that the scope of the present inventions extend to all such modifications and/or additions and that the scopes of the present inventions are limited solely by the claims set forth herein.

The invention claimed is:

1. A strapless bra comprising:

a fabric construction including bra cups and a back strap;

at least one adhesive patch on an interior surface of the fabric construction and configured to releasably adhere the fabric construction to the skin of a wearer of the strapless bra;

the at least one adhesive patch including a first adhesive patch; and the first adhesive patch including:

a first silicone layer of a first silicone polymer; and a second silicone layer of a second silicone polymer, which is harder than the first silicone polymer.

2. The strapless bra of claim 1 wherein the fabric construction is between the first silicone layer and the second silicone layer.

3. The strapless bra of claim 1 wherein a portion of the fabric construction adjacent the second silicone layer is permeated with silicone of the second silicone layer during a curing process of the second silicone layer.

4. The strapless bra of claim 3 wherein the first silicone layer is bonded to the second silicone layer during the curing process.

5. The strapless bra of claim 1 wherein the first silicone polymer has a hardness of between Shore OO 05 and Shore A 10, and the second silicone polymer has a hardness of between Shore A 10 and Shore A 50.

6. The strapless bra of claim 1 wherein the first silicone polymer has a hardness of less than Shore A 10, and the second silicone polymer has a hardness of at least Shore A 10.

7. The strapless bra of claim 1 wherein the first adhesive patch includes a fabric layer sandwiched between the first and second silicone layers, and the fabric layer is sewn directly to the fabric construction.

8. The strapless bra of claim 1 wherein the first silicone layer bonds the second silicone layer to the fabric construction.

9. The strapless bra of claim 1 wherein the second silicone layer bonds the first silicone layer to the fabric construction.

10. The strapless bra of claim 1 wherein: the bra cups include first and second bra cups; the back strap includes a first back strap portion and an opposite second back strap portion; the fabric construction includes a center gore portion; the at least one adhesive patch includes: (a) a first adhesive wing patch on the first back strap portion and a second adhesive wing patch on the second back strap portion, (b) a first adhesive cup patch on the first cup, and a second adhesive cup patch on the second cup, (c) a first front band adhesive patch on a front band underneath the first cup, and a second front band adhesive patch on a front band underneath the second cup, and (d) a gore adhesive patch on the center gore portion; and the first adhesive patch is one of the patches of (a), (b), (c) or (d).

11. The strapless bra of claim 1 wherein the back strap includes first and second back strap portions attachable together.

12. The strapless bra of claim 1 wherein:

the fabric construction includes (a) a non-elastic fabric center gore connecting the cups, (b) non-elastic fabric wings adjacent to the cups, and (c) the back strap is a band positioned adjacent to the wings and is either a singular section or two separate sections able to clasp together and encircle the wearer and made primarily from an elastic material except along a non-elastic inner section of the band;

the first adhesive patch is on the non-elastic inner section; and the elastic material has a percentage of stretch greater that 25% in any direction and the non-elastic fabric has a percentage of stretch less than 5% in any direction.

13. The strapless bra of claim 1 wherein the first silicone layer is against the interior surface, and the first adhesive patch includes a layer of fabric embedded within the first silicone layer and having less than 5% stretch in any direction.

14. A strapless bra comprising:

a fabric construction including bra cups and a back strap;

a fabric layer of the fabric construction having less than 5% stretch in any direction;

at least one adhesive patch on an interior surface of the fabric construction and configured to releasably adhere the fabric construction to the skin of a wearer of the strapless bra;

the at least one adhesive patch including a first adhesive patch; and the first adhesive patch including:

a layer of a soft silicone polymer;

the soft silicone polymer having a hardness of less than Shore A 10;

the layer of soft silicone polymer being attached to an area of the fabric construction where the fabric layer is permeated with hard silicone polymer; and the hard silicone polymer having a hardness of at least Shore A 10.

15. The strapless bra of claim 14 wherein the back strap is constructed of an elastic fabric having a percentage of stretch greater than 25% in any direction.

16. The strapless bra of claim 14 wherein the layer of soft silicone polymer is cured into the hard silicone polymer.

17. The strapless bra of claim 14 further comprising a layer of fabric embedded within the soft silicone polymer.

18. A method making an adhesive patch of a strapless bra, comprising:

attaching a polymer layer to bra fabric which is permeated with a first polymer;

an exposed surface of the polymer layer when in a cured state forming an adhesive surface adapted for intimate contact with the skin of the wearer of the strapless bra which includes a fabric construction including bra cups, a back strap and the fabric; and the first polymer being a harder polymer than a second polymer of the cured polymer layer.

19. The method of claim 18 wherein the attaching includes the polymer layer being a cured polymer layer.

20. The method of claim 18 wherein the second polymer has a hardness of less than Shore A 10 and the first polymer has a hardness of at least Shore A 10.

21. The method of claim 18 wherein the fabric construction has less than 5% stretch in any direction.

22. The method of claim 18 wherein the attaching includes placing the second polymer in an uncured state on the permeated fabric and allowing the second polymer to cure onto and thereby become affixed to the first polymer and to form the cured soft polymer layer.

23. The method of claim 18 further comprising before the attaching, placing the first polymer in an uncured state on the fabric and allowing the first polymer to cure and permeate into the fabric.

24. The method of claim 23 wherein the placing includes placing the first polymer on an inward surface of the fabric.

25. The method of claim 23 wherein the polymer layer is a cured polymer layer, and the attaching includes placing the cured polymer layer on the curing first polymer and thereby becoming affixed to the permeated fabric.

26. The method of claim 18 wherein the polymer layer forms at least in part a first polymer layer patch on the fabric construction, and further comprising forming a second polymer layer patch on the fabric construction spaced from the first polymer layer patch on the fabric construction.

27. The method of claim 18 wherein the back strap is a band that is either a singular section or two separate sections able to clasp together.

28. The method of claim 18 wherein the attaching the polymer layer includes the first polymer being cured polymer.

29. A method of making an adhesive patch of a strapless bra, comprising:

placing uncured first polymer on an inward surface of bra fabric;

while the first polymer is curing on and permeating into the inward surface, placing a cured second polymer layer on the still-curing first polymer and thereby the second polymer layer becoming bonded to the fabric when the first polymer cures and an exposed surface of the second polymer layer forming an adhesive surface adapted for intimate contact with the skin of the wearer of the strapless bra which includes a fabric construction including bra cups, a back strap and the fabric; and the first polymer being a harder polymer than the polymer of the cured second polymer layer.

30. The strapless bra of claim 1 wherein the bra cups include first and second bra cups, and the fabric construction further includes a center gore portion, and a front band portion, and the first adhesive patch is on the gore portion or the back strap.

31. The strapless bar of claim 30 wherein the at least one adhesive patch includes a second adhesive patch which is on the other of the gore portion or the back strap.

32. The strapless bra of claim 30 wherein the back strap includes a first back strap portion and a second back strap portion releasably attachable to the first back strap portion.

33. The strapless bra of claim 30 wherein the first adhesive patch is on the back strap and defines an adhesive wing patch.

34. The strapless bra of claim 14 wherein the bra cups include first and second bra cups, and the fabric construction further includes a center gore portion and a front band portion, and the first adhesive patch is on the gore portion or the back strap.

35. The strapless bar of claim 34 wherein the at least one adhesive patch includes a second adhesive patch which is on the other of the gore portion or the back strap.

36. The strapless bra of claim 34 wherein the back strap includes a first back strap portion and a second back strap portion releasably attachable to the first back strap portion.

37. The strapless bra of claim 34 wherein the first adhesive patch is on the back strap and defines an adhesive wing patch.

38. The method of claim 18 wherein the fabric construction includes a center gore portion, and the fabric is part of either the gore portion or the back strap.

39. The method of claim 29 wherein the fabric construction includes a center gore portion, and the fabric is part of either the gore portion or the back strap.

* * * * *